US006186102B1

(12) United States Patent
Kosuge et al.

(10) Patent No.: US 6,186,102 B1
(45) Date of Patent: Feb. 13, 2001

(54) VALVE OPERATING SYSTEM FOR INTERNAL COMBUSTION ENGINE

(75) Inventors: Mamoru Kosuge; Toshiyuki Sato, both of Wako; Toshitsugu Oomori; Kazuhiko Hayashi, both of Toyama, all of (JP)

(73) Assignees: Honda Giken Kogyo Kabushiki Kaisha, Tokyo; Tanaka Seimitsu Kogyo Co., Ltd., Toyama, both of (JP)

( * ) Notice: Under 35 U.S.C. 154(b), the term of this patent shall be extended for 0 days.

(21) Appl. No.: 09/468,916

(22) Filed: Dec. 22, 1999

(30) Foreign Application Priority Data

Dec. 22, 1998 (JP) ..... 10-365083
Sep. 13, 1999 (JP) ..... 11-258834

(51) Int. Cl.[7] ..... F01L 1/18; F01L 13/00

(52) U.S. Cl. ..... 123/90.16; 123/90.39; 123/90.42

(58) Field of Search ..... 123/90.15, 90.16, 123/90.17, 90.39, 90.42, 90.44

(56) References Cited

U.S. PATENT DOCUMENTS 5,460,130 * 10/1995 Fukuzawa et al. ..... 123/90.16
5,592,907 * 1/1997 Hasebe et al. ..... 123/90.16
5,931,133 * 8/1999 Giannone et al. ..... 123/90.5
5,960,754 * 10/1999 Sugimoto et al. ..... 123/90.15
5,979,379 * 11/1999 Sato et al. ..... 123/90.16

FOREIGN PATENT DOCUMENTS 10-73009 3/1998 (JP) .

* cited by examiner

*Primary Examiner*—Wellun Lo
(74) *Attorney, Agent, or Firm*—Arent Fox Kintner Plotkin & Kahn, PLLC

(57) ABSTRACT

In a valve operating system for an internal combustion engine, a support shaft supporting a roller is fitted in a fitting bore of a rocker arm, and a pin fixed in the rocker arm engages with an engage groove provided on the outer surface of the support shaft so as to extend in a direction tangential to an imaginary circle about the axis of the support shaft, an insertion bore which extends in a straight line and connects to an inner surface of a fitting bore at a position corresponding to the engage groove of the support shaft is provided in the rocker arm and the pin engaging with the engage groove by being inserted into the insertion bore is engaged with the rocker arm by crimping at least one end of the pin with flat punches so as to be fixed in the rocker arm. The pin can thus be fixed effectively in the rocker arm while maintaining the rigidity of the rocker arm.

6 Claims, 10 Drawing Sheets

VALVE OPERATING SYSTEM FOR INTERNAL COMBUSTION ENGINE

BACKGROUND OF THE INVENTION

1. Field of the Invention

The present invention relates to a valve operating system for an internal combustion engine wherein a support shaft supporting in a rotatable manner a roller which is in rolling contact with a valve operating cam is fitted in a fitting bore provided in a rocker arm, an engage groove which extends in a direction tangential to an imaginary circle about the axis of the aforementioned support shaft is provided on the outer surface of the aforementioned support shaft, and a pin engaging with the aforementioned engage groove is fixed in the aforementioned rocker arm.

2. Description of the Prior Art

In the art, such valve operating system is already known from Japanese Patent Application Laid-open No. 10-73009, etc.

In such valve operating system, the engagement of the pin, which is fixed in the rocker arm, with the engage groove on the support shaft prevents the support shaft from moving in its axial direction and rotating about its axis, and for the case above in the art the pin is press-fitted into a press-fit bore provided in the rocker arm so as to fix the pin in the rocker arm. However, in comparison with the support shaft which supports the roller in a rotatable manner, the pin has a smaller diameter and the press-fit bore also has a small diameter, and it is therefore difficult to enhance the precision of the internal diameter of the press-fit bore and the precision of the press-fit allowance of the pin. As a result, it is difficult to say that the operability of press-fitting a pin is excellent. Moreover, if the press-fit load against the pin is increased in order to effectively prevent it from falling out, a large load is applied to the rocker arm which is undesirable in terms of ensuring the rigidity of the rocker arm.

SUMMARY OF THE INVENTION

The present invention has been carried out in view of the abovementioned circumstances, and it is an objective of the present invention to provide a valve operating system for an internal combustion engine which can solve the above-mentioned problems caused by the press-fitting of a pin and can fix the pin in the rocker arm.

In order to achieve the above-mentioned objective, according to a first characteristic of the present invention, a valve operating system for an internal combustion engine is provided, the system comprising a support shaft for supporting in a rotatable manner a roller which is in rolling contact with a valve operating cam is fitted in a fitting bore provided in a rocker arm, an engage groove which extends in a direction tangential to an imaginary circle about the axis of the aforementioned support shaft is provided on an outer surface of the aforementioned support shaft and a pin which engages with the aforementioned engage groove is fixed in the aforementioned rocker arm, wherein an insertion bore which extends in a straight line and connects through to an inner surface of the aforementioned fitting bore at a position corresponding to the aforementioned engage groove of the support shaft is provided in the aforementioned rocker arm and the aforementioned pin inserted into the aforementioned insertion bore is engaged with the aforementioned rocker arm by crimping at least one end of the aforementioned pin with a flat punch so that it engages with the aforementioned rocker arm.

In accordance with the above-mentioned arrangement of the first characteristic, when the pin is fixed in the rocker arm, since at least one end of the pin is crimped, even if the pin having a small diameter is used, the fixing operation becomes easy in comparison with the case when a press fit type pin is used, and the pin can be effectively fixed in the rocker arm with improved operability. Moreover, since at least one end of the pin is crimped by a flat punch, by setting the diameter of the flat punch so that it is larger than the diameter of the pin, the pin can be crimped effectively even when the crimping position of the flat punch relative to the pin is slightly displaced and degradation of the rigidity of the crimped part due to displacement of the crimping position is not caused.

In addition to the above-mentioned first characteristic, according to a second characteristic of the present invention, a pair of recesses are provided on the aforementioned rocker arm, each of which is formed so as to have a diameter larger than the internal diameter of the aforementioned insertion bore, they are connected to the opposite ends of the aforementioned insertion bore, and open at an outer surface of the aforementioned rocker arm on opposite sides thereof to each other; one end of the aforementioned pin is crimped so as to engage with a step between one of the aforementioned two recesses and the insertion bore, another end of the pin is integrally formed with an engage flange which engages with a step between the other one of the aforementioned two recesses and the insertion bore, and at least a part of the aforementioned pin which engages with the aforementioned engage groove is formed to have a hardness higher than that of the opposite ends of the aforementioned pin.

In accordance with such second characteristic, when the pin is fixed in the rocker arm, since one end of the pin is crimped and engages with the step between one of the recesses and the insertion bore in a state in which the engage flange at the other end of the aforementioned pin is engaged with the step between the other recess and the insertion bore, the fixing operation is easy in comparison with the case in which both ends of the pin are crimped and the pin can be fixed effectively in the rocker arm with further improved operability. Furthermore, the crimped part at one end of the pin and the engage flange can be housed inside the two recesses and do not protrude from the outer surface of the rocker arm, the length of the insertion bore, that is to say, the length of the pin can be reduced by the portion corresponding to the recesses, the precision with which the support shaft is positioned by the pin can be improved while preventing as much as possible deformation of an intermediate part of the pin due to crimping, at the same time the inertial mass of the rocker arm can be reduced by the lightening of the whole rocker arm which is achieved, and high speed operation of the engine can advantageously be effected. Moreover, since the hardness of at least the part of the pin engaging with the engage groove is comparatively high, the support shaft can be positioned effectively while preventing abrasion and deformation of the pin as much as possible, and since the hardness of the two ends of the pin is comparatively low, the crimping operation becomes easy and the crimping precision is enhanced.

In addition to the above-mentioned first characteristic, according to a third characteristic of the present invention, a pair of recesses are formed so as to have a diameter larger than an internal diameter of the aforementioned insertion bore, and the recesses are connected to the opposite ends of the aforementioned insertion bore, and open at an outer surface of the aforementioned rocker arm on opposite sides thereof to each other, both ends of the pin which are inserted into the aforementioned insertion bore so as to engage with the aforementioned engage groove, and are respectively crimped by a flat punch so as to engage with the steps between the aforementioned two recesses and the insertion bore, and at least a part of the aforementioned pin which engages with the aforementioned engage groove is formed to have a hardness higher than that of the opposite ends of the aforementioned pin.

In accordance with such a third characteristic, when the pin is fixed in the rocker arm, since the opposite ends of the aforementioned pin are crimped even if the pin having a small diameter is used, the fixing operation becomes easy in comparison with the case when a press fit type pin is used, and the pin can be fixed effectively in the rocker arm with improved operability. Furthermore, since the opposite ends of the pin are crimped with the flat punch, by setting the diameter of the flat punches so as to be larger than the diameter of the pin, the pin can be crimped effectively even when the crimping position of the flat punch relative to the pin is slightly displaced, and degradation of the rigidity of the crimped part due to displacement of the crimping position is not caused. Moreover, since the opposite ends of the pin are crimped inside the recesses which are connected to the opposite ends of the insertion bore, the crimped parts do not protrude from the outer surface of the rocker arm. Furthermore, the length of the insertion bore, that is to say, the length of the pin can be reduced by the portion corresponding to the recesses and the precision with which the support shaft is positioned by the pin can be improved while preventing deformation of the intermediate part of the pin due to the crimping as much as possible; at the same time the inertial mass of the rocker arm can be reduced by the lightening of the whole rocker arm which is achieved, and thus high speed operation of the engine can advantageously be effected. Moreover, since the hardness of at least the part of the pin engaging with the engage groove is comparatively high, the support shaft can be positioned effectively while preventing abrasion and deformation of the pin as much as possible, and since the hardness of the opposite ends of the pin is comparatively low, the crimping operation becomes easy and the crimping precision is enhanced.

In addition to the above-mentioned first characteristic, according to a fourth characteristic of the present invention, the aforementioned fitting bore and the aforementioned insertion bore are formed in each of a plurality of the aforementioned rocker arms, a plurality of the aforementioned support shafts which are each formed in a cylindrical shape having the aforementioned engage groove are fitted into each of the aforementioned fitting bores, a plurality of the pins which are inserted into the aforementioned insertion bores engages with the aforementioned engage grooves respectively, an associative operation switching means having sliding members which are slidably fitted in the aforementioned support shafts is provided in the aforementioned rocker arms so as to switch over between connection and connection-release of the aforementioned rocker arms, and the aforementioned engage grooves have maximum depth each set to be less than ½ of the diameter of a pin engaging with the engage groove.

In accordance with such fourth characteristics, the support shafts are formed in a cylindrical shape so as to fit the sliding members forming the associative operation switching means in order to switch over a plurality of rocker arms between connection and connection-release, and since the maximum depth of each of the engage grooves is set to be less than ½ of the diameter of the corresponding pins, it is possible to prevent the rigidity of the support shafts from being degraded in the area of the engage grooves, and thus a smooth sliding motion of each of the sliding members can be guaranteed.

The above-mentioned objectives, other objectives, characteristics and advantages of the present invention will become apparent from an explanation of preferable embodiments which will be described in detail below by reference to the attached drawings.

BRIEF DESCRIPTION OF THE DRAWINGS

FIG. 1 is a vertical cross-sectional view taken along a line 1—1 in FIG. 2 showing a part of a valve operating system.

FIG. 2 is a plan view from arrow 2 in FIG. 1.

FIG. 3 is a cross-sectional view taken along a line 3—3 in FIG. 2.

FIG. 4 is a cross-sectional view taken along a line 4—4 in FIG. 3.

FIG. 5 is an enlarged cross-sectional view taken along a line 5—5 in FIG. 2.

FIG. 6 is a cross-sectional view corresponding to FIG. 5 before the pin is crimped.

FIG. 7 is a cross-sectional view taken along a line 7—7 in FIG. 2.

FIG. 8 is a cross-sectional view taken along a line 8—8 in FIG. 4.

FIG. 9 is a cross-sectional view taken along a line 9—9 in FIG. 2.

FIG. 10 is a cross-sectional view taken along a line 10—10 in FIG. 4.

FIG. 11 is a cross-sectional view taken along a line 11—11 in FIG. 10.

DETAILED DESCRIPTION OF THE PREFERRED EMBODIMENTS

Figure 1:
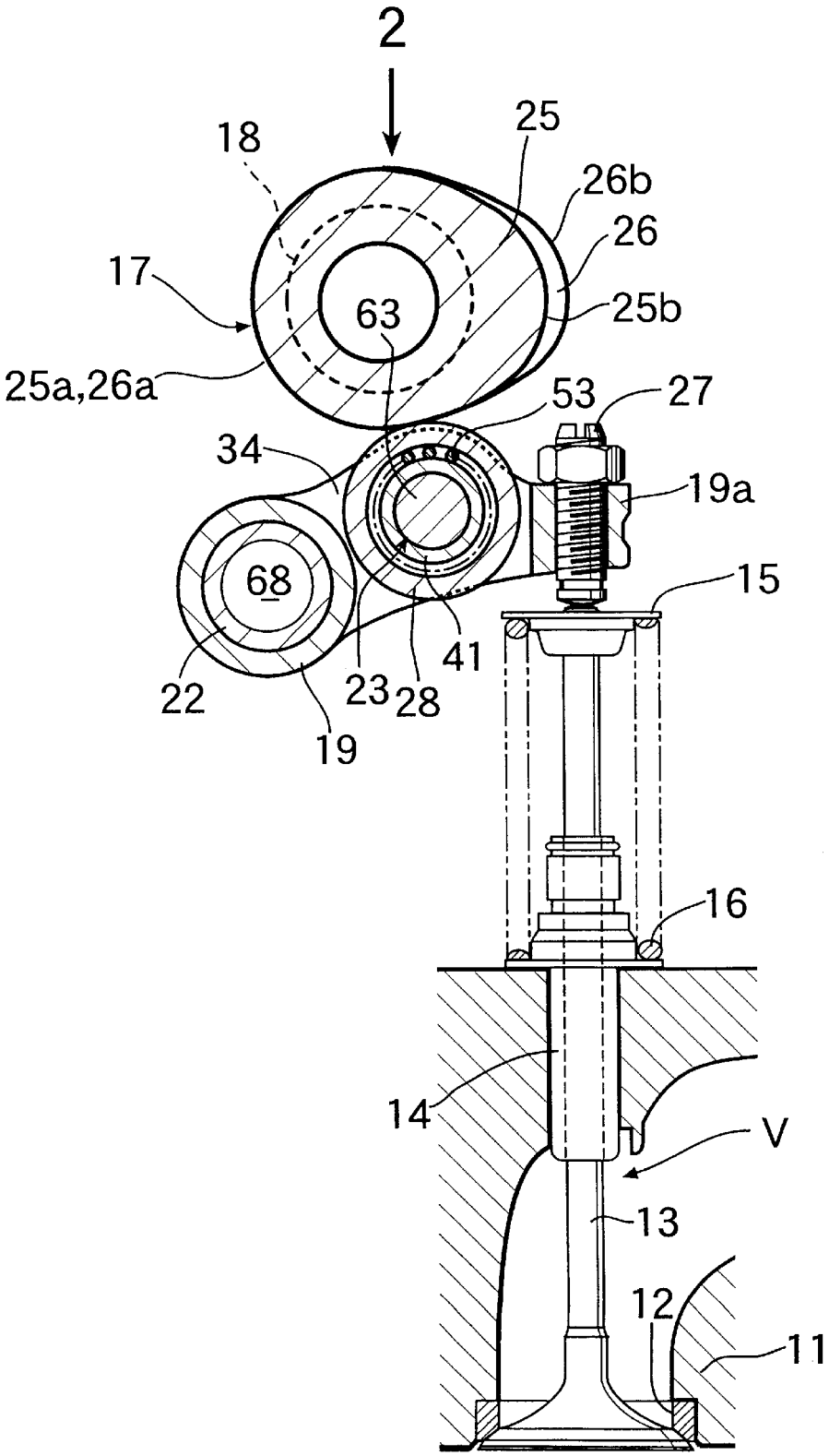
FIGS. 1 to 11 illustrate a first embodiment of the present invention.

A first embodiment of the present invention is explained below by reference to FIGS. 1 to 11. Firstly, as shown in FIG. 1, a cylinder head 11 of a multi-cylinder engine such as, for example, an inline four-cylinder internal combustion engine comprises a pair of intake valve openings 12 . . . for each cylinder. The two intake valve openings 12 . . . are opened and closed individually by engine intake valves V . . . and stems 13 . . . of these intake valves V . . . are fitted in a slidable manner in corresponding guide tubes 14 . . . provided in the cylinder head 11. Valve springs 16 . . . surrounding each of the stems 13 . . . are provided between retainers 15 . . . provided on the top part of the stems 13 . . . which protrude upwards from each of the guide tubes 14 . . . and the cylinder head 11, and the intake valves V . . . are biased in a direction which closes the intake valve openings 12 . . . by the spring force of these valve springs 16 . . . .

Figure 2:
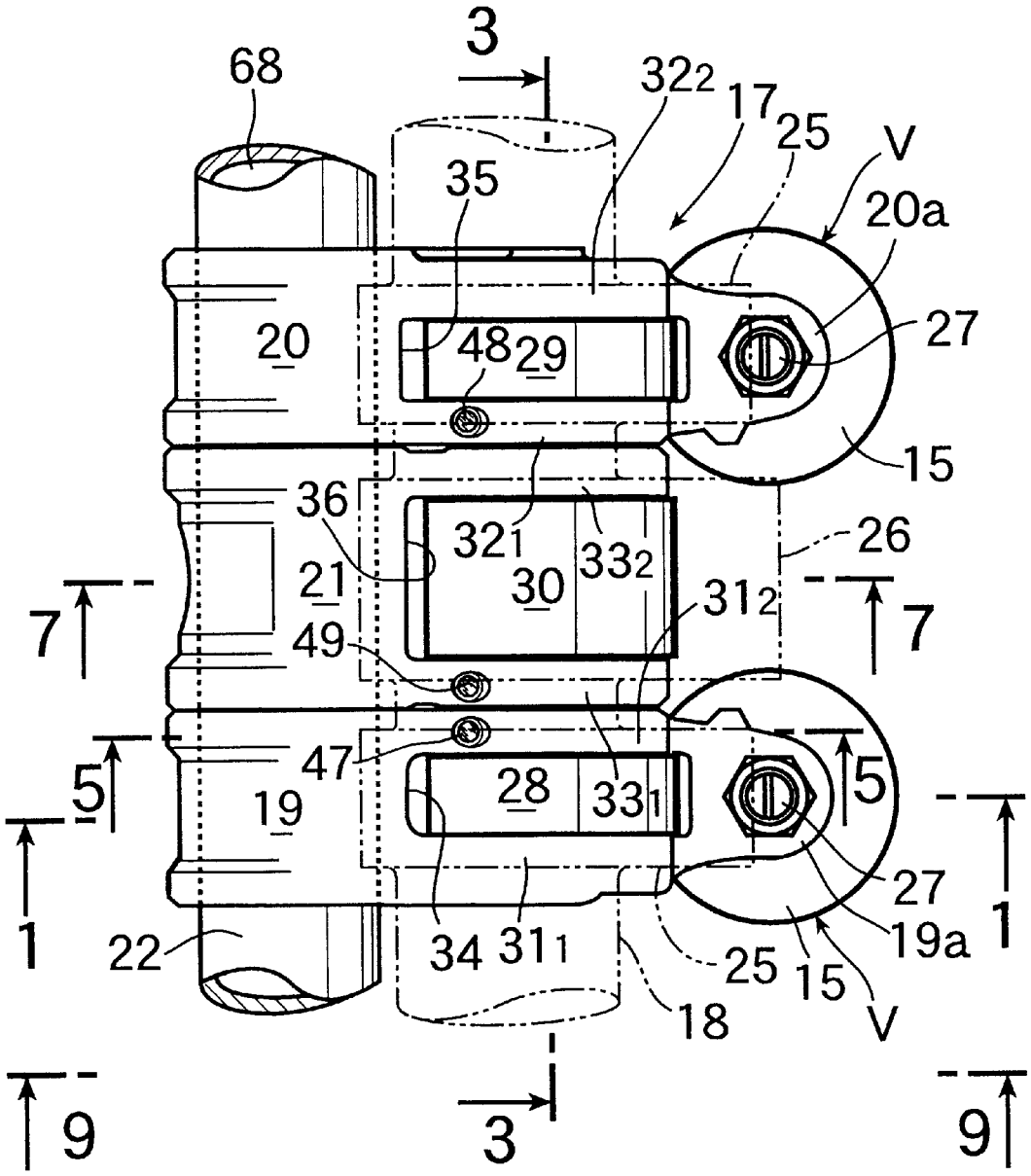
Figure 3:
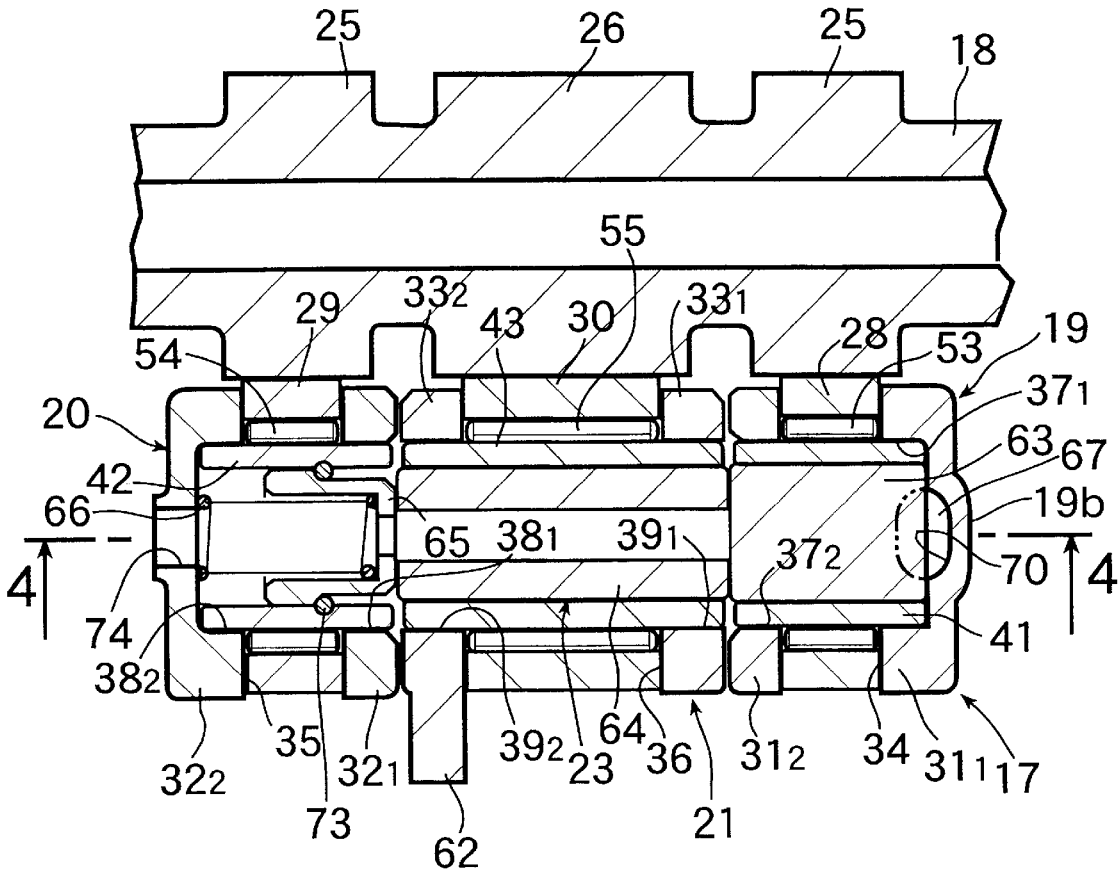
Figure 4:
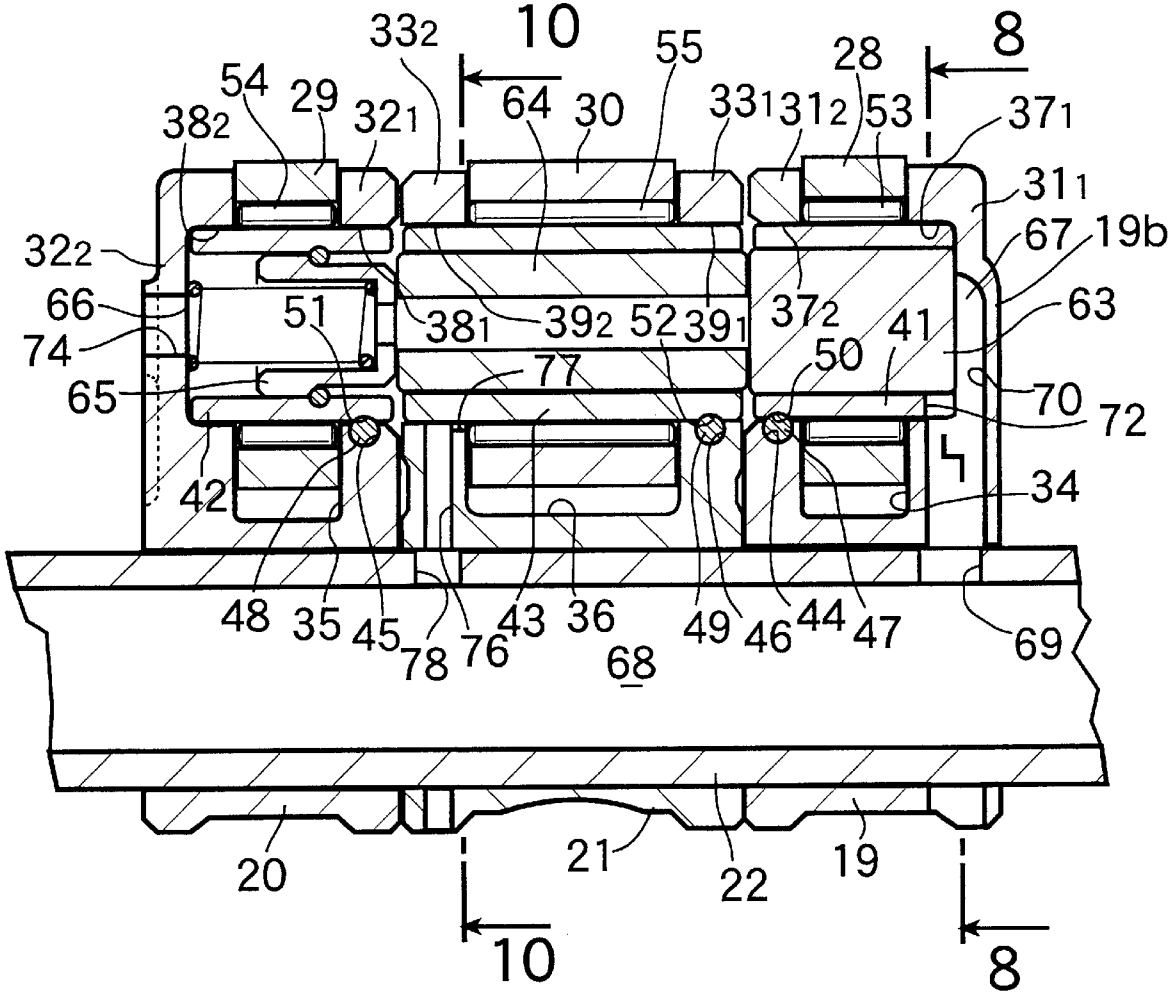

By reference to FIGS. 2 to 4 together with the above drawing, the two intake valves V, V are connected to a valve operating system 17, and the valve operating system 17 comprises a camshaft 18 which is operatively connected to a crankshaft (not illustrated) at a reduction ratio of ½, a first driving rocker arm 19 which is operatively connected to one of the two intake valves V . . . , a second driving rocker arm 20 which is operatively connected to the other one of the two intake valves V . . . , a free rocker arm 21 which can become free from the two intake valves V . . . , a fixed rocker shaft 22 which is a support member having an axis parallel to the camshaft 18 and supports the aforementioned rocker arms 19, 20, 21 in common for swinging movement, and an associative operation switching means 23 which can switch over each of the rocker arms 19 to 21 between connection and connection-release.

On the camshaft 18 are provided a high speed valve operating cam 26 and low speed valve operating cams 25, 25 which are arranged on the opposite sides of the high speed valve operating cam 26 so as to correspond to the opposite intake valves V . . . in a fixed manner.

The high speed valve operating cam 26 has a cam profile so as to open and close the two intake valves V . . . in a high speed operating range of the engine, and has a circular base part 26*a* which has a circular shape about the axis of the camshaft 18 and an elevated part 26*b* which protrudes outwards in a radial direction from the circular base part 26*a*. The low speed valve operating cam 25 has a cam profile so as to open and close the intake valves V . . . in a low speed operating range of the engine, and has a circular base part 25*a* which is formed so as to have a circular shape about the axis of the camshaft 18 and an elevated part 25*b* which protrudes outwards in a radial direction from the circular base part 25*a*, with the amount protruding from the circular base part 25*a* being smaller than the amount of the elevated part 26*b* of the high speed valve operating cam 26 protruding from the circular base part 26*a* over a central angle which is smaller than that of the elevated part 26*b*.

The first driving rocker arm 19, the second driving rocker arm 20 and the free rocker arm 21 are arranged adjacent to each other so that the free rocker arm 21 is interposed between the first and second driving rocker arms 19, 20, and are supported in common and swingably by the rocker shaft 22 in a rockable manner.

The first and the second driving rocker arms 19, 20 comprise integral arm parts 19*a*, 20*a* which extend in the direction of the intake valves V . . . , and tappet screws 27, 27 which are in close contact with the top ends of the stems 13 . . . of the two intake valves V . . . are threadedly engaged in the front ends of the arm parts 19*a*, 20*a* for advancing and retracting movements.

An opening 34 which opens vertically is provided in the first rocker arm 19 between the rocker shaft 22 and the tappet screw 27 so as to form first and second support walls $\mathbf{31}_1$, $\mathbf{31}_2$ on the opposite sides of the opening 34 which face each other in a direction parallel to the axis of the rocker shaft 22, and a cylindrical roller 28 which is in rolling contact with the low speed valve operating cam 25 is supported in the first driving rocker arm 19 in a rotatable manner so as to be arranged inside the aforementioned opening 34. An opening 35 which opens vertically is also provided in the second rocker arm 20 between the rocker shaft 22 and the tappet screw 27 so as to form first and second support walls $\mathbf{32}_1$, $\mathbf{32}_2$ on the opposite sides of the opening 35 which face each other in a direction parallel to the axis of the rocker shaft 22, and a cylindrical roller 29 which is in rolling contact with the low speed valve operating cam 25 is supported in the second driving rocker arm 20 in a rotatable manner so as to be arranged inside in the aforementioned opening 35. Furthermore, an opening 36 which opens vertically as well as at a side opposite to the rocker shaft 22 is also provided in the free rocker arm 21 so as to form first and second support walls $\mathbf{33}_1$, $\mathbf{33}_2$ which face each other in a direction parallel to the axis of the rocker shaft 22, and a cylindrical roller 30 which is in rolling contact with the high speed valve operating cam 26 is supported in the free rocker arm 21 in a rotatable manner so as to be arranged inside the aforementioned opening 36.

A bottomed first fitting bore $\mathbf{37}_1$ , which opens onto the side of the free rocker arm 21 is provided in the first support wall $\mathbf{31}_1$ of the first driving rocker arm 19 in a direction parallel to the axis of the rocker shaft 22, and a second fitting bore $\mathbf{37}_2$ which opens at opposite ends thereof is provided coaxially with the first fitting bore $\mathbf{37}_1$ in the second support wall $\mathbf{31}_2$. A first fitting bore $\mathbf{38}_1$ with both ends thereof open is provided in a direction parallel to the axis of the rocker shaft 22 in the first support wall $\mathbf{32}_1$ of the second driving rocker arm 20 which is at the side of the free rocker arm 21, and a bottomed second fitting bore $\mathbf{38}_2$ which opens onto the side of the free rocker arm 21 is provided in the second support wall $\mathbf{32}_2$ coaxially with the first fitting bore $\mathbf{38}_1$. A first fitting bore $\mathbf{39}_1$ with both ends thereof open is provided in a direction parallel to the axis of the rocker shaft 22 in the first support wall $\mathbf{33}_1$ of the free rocker arm 21 which is at the side of the first driving rocker arm 19, and a second fitting bore $\mathbf{39}_2$ with both ends thereof open is provided coaxially with the first fitting bore $\mathbf{39}_1$ in the second support wall $\mathbf{33}_2$.

One end of a cylindrical support shaft 41 is fitted in the first fitting bore $\mathbf{37}_1$ of the first driving rocker arm 19 up to a position where it abuts against a closed end of the first fitting bore $\mathbf{37}_1$ and the other end of the aforementioned support shaft 41 is fitted in the second fitting bore $\mathbf{37}_2$. Furthermore, one end of a cylindrical support shaft 42 is fitted in the first fitting bore $\mathbf{38}_1$ of the second driving rocker arm 20, and the other end of the aforementioned support shaft 42 is fitted in the second fitting bore $\mathbf{38}_2$ up to a position where it abuts against a closed end of the second fitting bore $\mathbf{38}_2$. Moreover, the two ends of a cylindrical support shaft 43 are fitted in the first and second fitting bores $\mathbf{39}_1$, $\mathbf{39}_2$ respectively of the free rocker arm 21.

Figure 5:
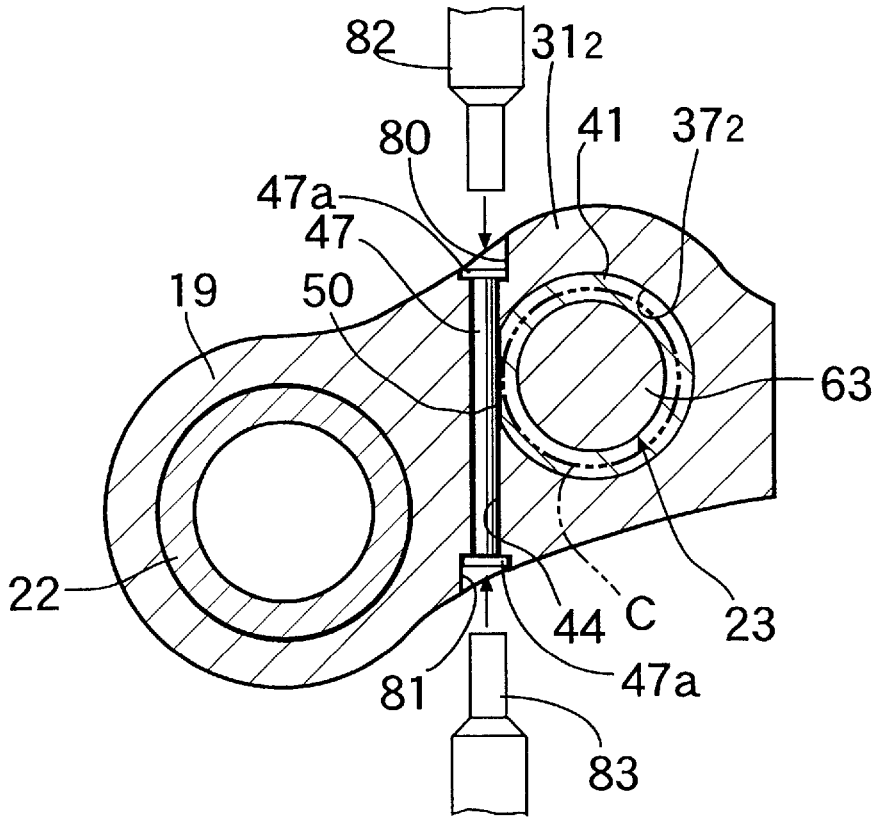

By reference to FIG. 5 together with the above drawings, an insertion bore 44 is provided on the second support wall $\mathbf{31}_2$ of the first driving rocker arm 19 which extends in a straight line in a direction intersecting a straight line joining the axis of the rocker shaft 22 and the axis of the second fitting bore $\mathbf{37}_2$ and connects through to the inner surface of the second fitting bore $\mathbf{37}_2$; at the same time recesses 80, 81 are provided which are connected to the opposite ends of the above-mentioned insertion bore 44 and open onto the upper outer surface and the lower outer surface of the first driving rocker arm 19 and the two recesses 80, 81 are formed so as to have a larger diameter than that of the insertion bore 44.

Figure 6:
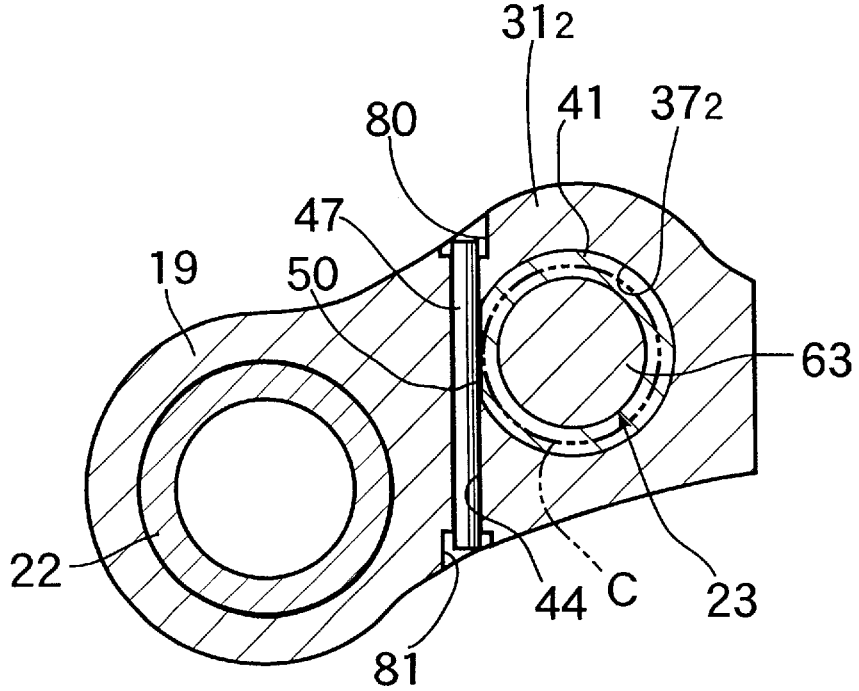

On the other hand, an engage groove 50 is provided on the outer surface of the support shaft 41 which extends in a direction tangential to an imaginary circle C about the axis of the above-mentioned support shaft 41 so as to correspond to the opening of the above-mentioned insertion bore 44 on the inner surface of the second fitting bore $\mathbf{37}_2$, and a pin 47 which extends in a straight line is inserted into the insertion bore 44 as shown in FIG. 6 so that the intermediate part of the above-mentioned pin 47 engages with the engage groove 50.

Opposite ends of the pin 47 inserted into the insertion bore 44 are crimped by flat punches 82, 83 respectively having an outer diameter smaller than the inner diameter of the corresponding recesses 80, 81 as shown in FIG. 5. The crimped parts 47*a*, 47*a* which have been flattened into a disc shape by the crimping engage with the steps between the aforementioned two recesses 80, 81 and the insertion bore 44, and the support shaft 41 is thus fixed to the first driving rocker arm 19.

A support shaft 42 is fixed to the first support wall $\mathbf{32}_1$ of the second driving rocker arm 20 by the same arrangement as that used for fixing the support shaft 41 in the first driving rocker arm 19. That is to say, a pin 48 which is inserted into an insertion bore 45 provided in the first support wall $\mathbf{32}_1$ of the second driving rocker arm 20, both ends of which are crimped, engages with an engage groove 51 provided on the outer surface of the support shaft 42 fitted in the first fitting bore $\mathbf{38}_1$.

A support shaft 43 is fixed to the first support wall $\mathbf{33}_1$ of the free rocker arm 21 by the same arrangement as that used for fixing the support shaft 41 in the first driving rocker arm 19 and the support shaft 42 in the second driving rocker arm 20. That is to say, a pin 49 which is inserted into an insertion bore 46 provided on the first support wall $\mathbf{33}_1$ of the free rocker arm 21, both ends of which are crimped, engages with an engage groove 52 provided on the outer surface of the support shaft 43 fitted in the first fitting bore $\mathbf{39}_1$.

The maximum depth of each of the aforementioned engage grooves 50, 51, 52 is set to be less than ½ of the radius of the pins 47, 48, 49 corresponding to engage grooves 50 to 52 respectively, and is preferably about ½ of the radius of the pins 47 to 49. By so doing, not only does the process involved in the formation of the engage grooves 50 to 52 on the support shafts 41 to 43 respectively becomes easy, but also degradation of the rigidity of the support shafts 41 to 43 due to the formation of the engage grooves 50 to 52 can be prevented as much as possible.

In addition, the hardness of at least the parts of the pins 47 to 49 engaging with the aforementioned engage grooves 50 to 52 respectively, that is to say, the parts of the pins 47 to 49 inserted into the insertion bores 44 to 46 respectively in this embodiment, is set so as to be higher than that of the two ends of the pins 47 to 49, that is to say, the ends protruding from the insertion bores 44 to 46 in this embodiment. The pins 47 to 49 are made of, for example, JIS SUJ2, and by subjecting the middle parts of the pins 47 to 49 in their axial directions to, for example, high frequency hardening, the hardness of part of the outer surface of the pins 47 to 49 can be enhanced. The hardness of at least the parts of the pins 47 to 49 engaging with the engage grooves 50 to 52 thus becomes, for example, $H_v$ 579 to 832 by high frequency hardening and the hardness of the opposite ends of the pins 47 to 49 which have not been hardened becomes, for example, $H_v$ 180 to 260.

A needle bearing 53 is interposed between the roller 28 and the support shaft 41 between the first and second support walls $\mathbf{31}_1$, $\mathbf{31}_2$ of the first driving rocker arm 19; a needle bearing 54 is interposed between the roller 29 and the support shaft 42 between the first and second support walls $\mathbf{32}_1$, $\mathbf{32}_2$ of the second driving rocker arm 20 and a needle bearing 55 is interposed between the roller 30 and the support shaft 43 between the first and second support walls $\mathbf{33}_1$, $\mathbf{33}_2$ of the free rocker arm 21.

Figure 7:
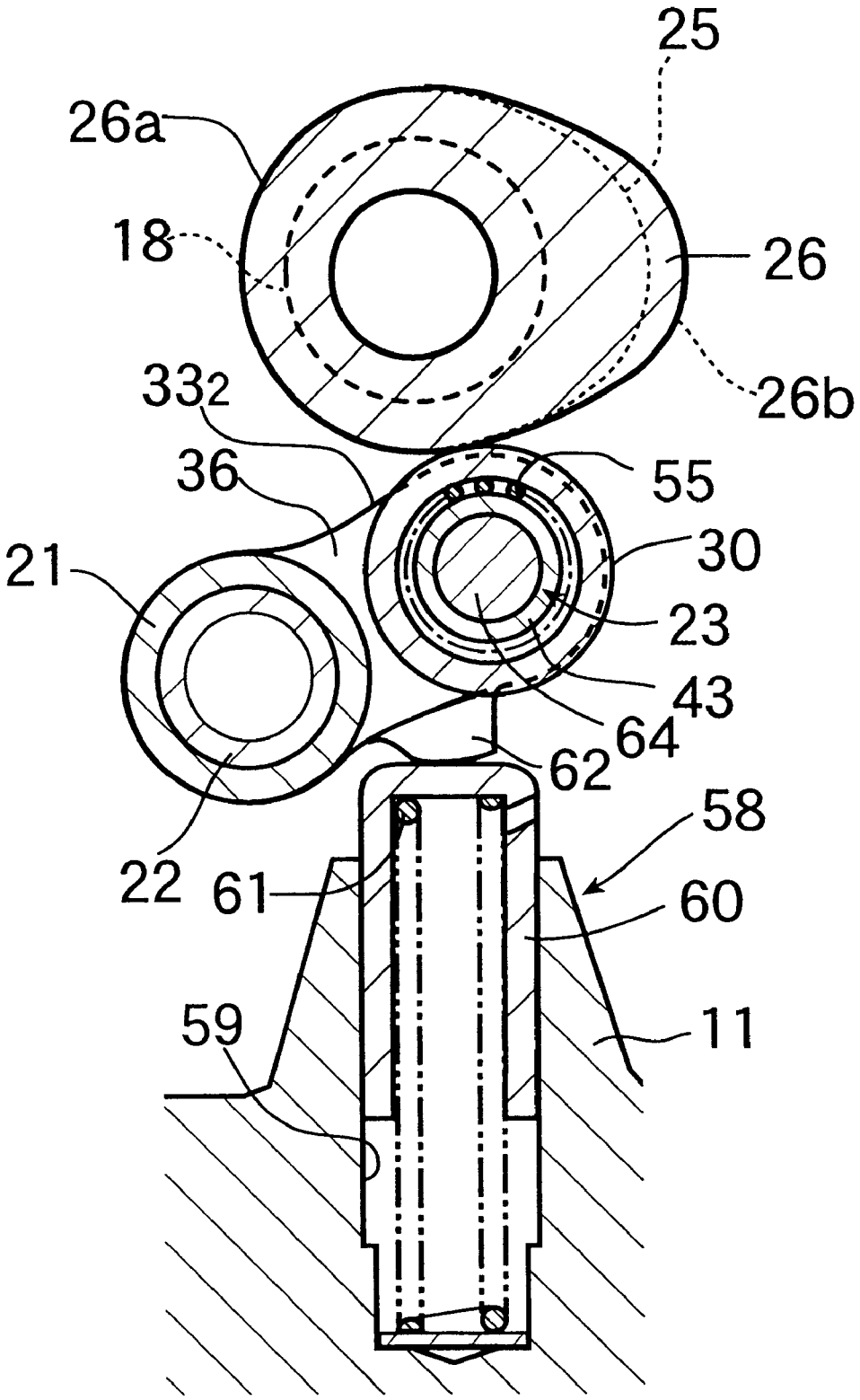

In FIG. 7, a lost motion mechanism 58 is provided on the cylinder head 11 beneath the free rocker arm 21, which applies a spring force to the free rocker arm 21 in a direction so as to put the roller 30 of the free rocker arm 21 in rolling contact with the high speed valve operating cam 26, and the above-mentioned lost motion mechanism 58 comprises a bottomed cylindrical lifter 60 which is fitted in a slidable manner in a sliding bottomed bore 59 which is provided in the cylinder head 11 so that its top is open and a spring 61 provided between the closed end of the aforementioned sliding bore 59 and the lifter 60.

On the other hand, the free rocker arm 21 includes a receiver 62 which is in contact with the top end of the lifter 60 so as to receive the spring force from the lost motion mechanism 58 and, among the first and second support walls $\mathbf{33}_1$, $\mathbf{33}_2$ of the free rocker arm 21, the receiver 62 is provided integrally with the lower part of the second support wall $\mathbf{33}_2$ so as to project downwards thereof whilst the pin 49 is inserted and fixed in the first support wall $\mathbf{33}_1$ to which the support shaft 43 is fixed.

An associative operation switching means 23 comprises a timing piston 63 which is a sliding member capable of switching over between connection and connection-release of the first driving rocker arm 19 and the free rocker arm 21 which are adjacent to each other, a bottomed cylindrical switch over piston 64 which is a sliding member capable of switching over between connection and connection-release of the free rocker arm 21 and the second driving rocker arm 20 which are adjacent to each other, a cylindrical regulating member 65 with a base which is a sliding member that is in contact with the switch over piston 64 on the side opposite to the timing piston 63, and a return spring 66 for baising the regulating member 65 toward the side of the switch over piston 64.

The timing piston 63 is fitted in the support shaft 41 of the first driving rocker arm 19 in a slidable manner, and a hydraulic chamber 67 is formed between one end of the timing piston 63 and the closed end of the first fitting bore $\mathbf{37}_1$ in which one end of the support shaft 41 is fitted. An oil passage 68 which is connected to a hydraulic source via a control valve (not illustrated) is formed, for example, coaxially inside the rocker shaft 22, and a through bore 69 is formed in the rocker shaft 22 so as to connect the aforementioned oil passage 68 continuously to a through passage 70 which is provided in the first support wall $\mathbf{31}_1$ of the first driving rocker arm 19 while connecting one of its ends to the hydraulic chamber 67.

Figure 8:
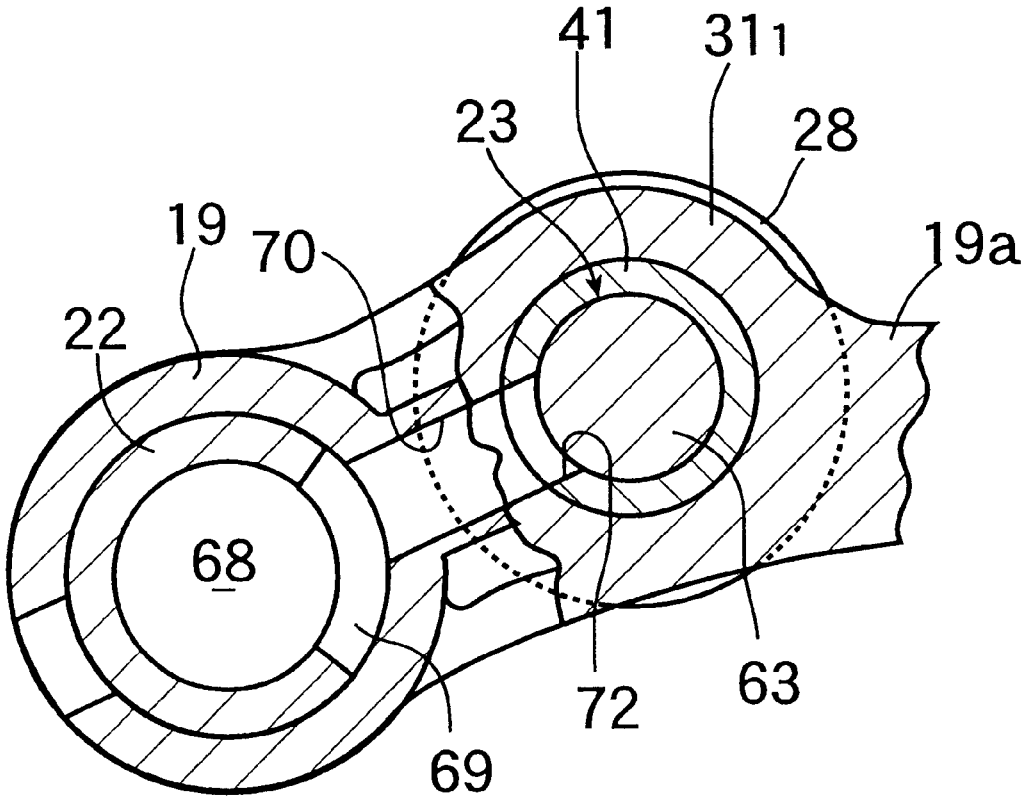

By reference to FIG. 8 together with the above drawings, the through passage 70 has a cross-sectional shape such that the dimension in a direction perpendicular to the direction in which the rocker arms 19 to 21 are arranged is longer than the dimension in the direction in which the rocker arms 19 to 21 are arranged, that is to say, the direction along the axis of the rocker shaft 22 in this embodiment and is provided in the first driving rocker arm 19 in the side of the first support wall $\mathbf{31}_1$ so as to extend along a plane almost perpendicular to the direction in which the rocker arms 19 to 21 are arranged; in order to connect the oil passage 68 to the through passage 70 continuously regardless of the swinging state of the first driving rocker arm 19, the through bore 69 is provided in the rocker shaft 22 over a greater range in the circumferential direction of the rocker shaft 22 than the range over which the through passage 70 faces the outer surface of the rocker shaft 22. Moreover, the other end of the through passage 70 opens onto the side of the first driving rocker arm 19 and therefore the middle part of the above-mentioned through passage 70 is intercepted by the rocker shaft 22.

Figure 9:
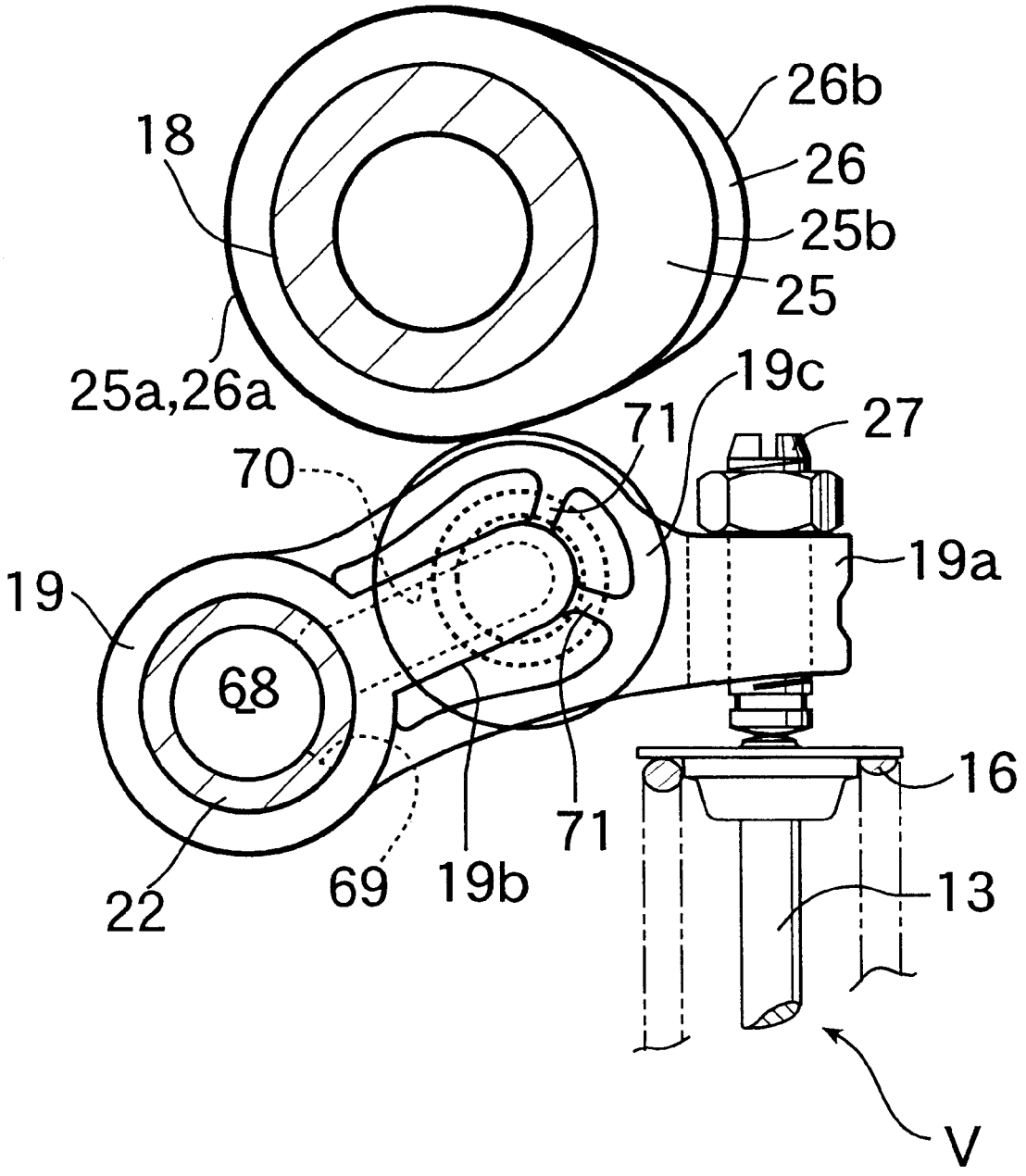

By reference to FIG. 9 together with the above drawings, an expanded part 19*b* which expands outwards so as to form the aforementioned through passage 70 is provided in the first driving rocker arm 19 on the outer surface at one end along the direction in which the rocker arms 19 to 21 are arranged, and a plurality of ribs, for example, two ribs 71, 71 are provided between the surrounding edge 19*c* of the aforementioned outer surface of the first driving rocker arm 19 and the aforementioned expanded part 19*b*.

The through passage 70 is provided in the first driving rocker arm 19 so that a part of the through passage 70 is placed at the side of the roller 28 rather than the side of one end of the aforementioned support shaft 41 in a direction parallel to the axis of the aforementioned rocker shaft 22, and a notch 72 having a shape corresponding to the above-mentioned through passage 70 is provided in the part of the one end of the aforementioned support shaft 41 corresponding to the aforementioned through passage 70. That is to say, working oil circulating the through passage 70 is guided to the hydraulic chamber 67 without its flow being inhibited by the support shaft 41.

The switch over piston 64 is fitted in a slidable manner in the support shaft 43 of the free rocker arm 21, so that one end thereof is in contact with the other end of the timing piston 63 for sliding movement relative to each other.

The regulating member 65 is formed into a bottomed cylindrical shape and is fitted in a slidable manner in the support shaft 42 of the second driving rocker arm 20, and the closed end of the regulating member 65 is in contact with the other end of the switch over piston 64 for sliding movement relative to each other. On the inner surface of the support shaft 42 is mounted a stopper ring 73 which is in contact with the regulating member 65 so as to prevent the regulating member 65 from falling out of the support shaft 42. The return spring 66 is provided between the closed end of the second fitting bore $\mathbf{38}_2$ of the second driving rocker arm 20 and the regulating member 65, and an open bore 74 is formed at the closed end of the aforementioned second fitting bore $\mathbf{38}_2$.

With regard to such an associative operation switching means 23, in a low speed operating region of the engine, the hydraulic pressure of the hydraulic chamber 67 is comparatively low, the plane in which the timing piston 63 and the switch over piston 64 are in contact is present at a position between the first driving rocker arm 19 and the free rocker arm 21, and the plane in which the switch over piston 64 and the regulating member 65 are in contact is present at a position between the free rocker arm 21 and the second driving rocker arm 20. Therefore, the rocker arms 19, 20, 21 are in relatively swingable states, and the two intake valves V . . . are operated to open and close with a timing and an amount of lift corresponding to the low speed valve operating cams 25, 25.

In a high speed operating region of the engine, a comparatively high hydraulic pressure is applied to the hydraulic chamber 67, the timing piston 63 fits in the support shaft 43 of the free rocker arm 21 while urging the switch over piston 64, and the switch over piston 64 fits in the support shaft 42 of the second driving rocker arm 20 while urging the regulating member 65. The rocker arms 19, 20, 21 are therefore in a state in which they are integrally connected, and the two intake valves V . . . are operated so as to open and close them with a timing and an amount of lift corresponding to the high speed valve operating cam 26.

Figure 10:
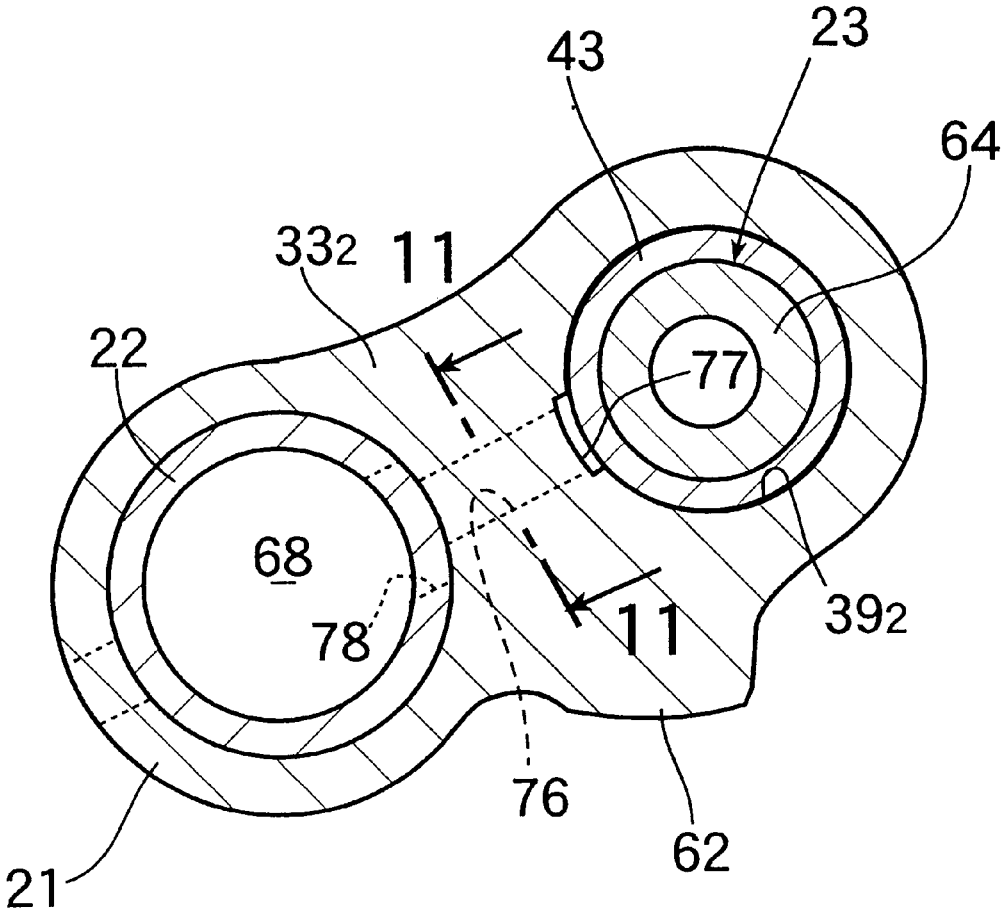
Figure 11:
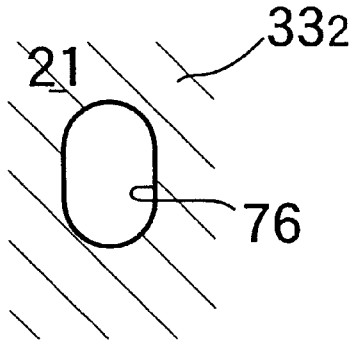

By reference to FIGS. 10 and 11 together with the above drawings, among the two support walls $\mathbf{33}_1$, $\mathbf{33}_2$ of the free rocker arm 21, in the side on which the receiver 62 is provided, that is to say, in the second support wall $\mathbf{33}_2$ is provided a lubricating oil passage 76 which is connected to the oil passage 68 of the rocker shaft 22 continuously so that one end of the lubricating oil passage 76 opens onto the inner surface of the second fitting bore $\mathbf{39}_2$, and a groove 77, one end of which is connected to one end of the aforementioned lubricating oil passage 76 and the other end of which opens onto the side of the bearing 55, is provided on the inner surface of the second fitting bore $\mathbf{39}_2$.

Furthermore,the aforementioned lubricating oil passage 76 is formed so as to have a cross-sectional shape in which the dimension in a direction almost perpendicular to the direction in which the rocker arms 19 to 21 are arranged is longer than the dimension in the direction almost parallel to the direction in which the rocker arms 19 to 21 are arranged, and in order to connect the oil passage 68 to the lubricating oil passage 76 continuously regardless of the swinging state of the free rocker arm 21, a through bore 78 is provided on the rocker shaft 22 over a greater range in the circumferential direction of the rocker shaft 22 than the range over which the lubricating oil passage 76 faces the outer surface of the rocker shaft 22. The other end of the lubricating oil passage 76 opens onto the side of the free rocker arm 21, and the middle part of the above-mentioned lubricating oil passage 76 is therefore intercepted by the rocker shaft 22.

The aforementioned rocker arms 19, 20, 21 are formed by metal injection moulding. The metal injection moulding may be performed by carrying out in sequence a step in which a starting powder and a binder such as a wax are kneaded, a step in which the compound obtained in the kneading step is granulated to give pellets, a step in which the above-mentioned pellets are injection moulded in a die, a step in which the binder is removed by heating the moulded product and a step in which a sintering treatment is applied.

The action of the first embodiment is explained below. The support shafts 41 to 43 for rotatably supporting the rollers 28 to 30 in order to reduce the valve operating load are fixed in the rocker arms 19 to 21 respectively, and the opposite ends of each of the support shafts 41 to 43 are fitted in the first fitting bores $\mathbf{37}_1$, $\mathbf{38}_1$, $\mathbf{39}_1$ and the second fitting bores $\mathbf{37}_2$, $\mathbf{38}_2$, $\mathbf{39}_2$ formed in the rocker arms 19 to 21 respectively. A pin 47 which is inserted into the insertion bore 44 provided in the second support wall $\mathbf{31}_2$ of the first driving rocker arm 19 engages with the engage groove 50 of the support shaft 41, a pin 48 which is inserted into the insertion bore 45 provided in the first support wall $\mathbf{32}_1$ of the second driving rocker arm 20 engages with the engage groove 51 of the support shaft 42 and a pin 49 which is inserted into the insertion bore 46 provided in the first support wall $\mathbf{33}_1$ of the free rocker arm 21 engages with the engage groove 52 of the support shaft 43. Movement in the axial direction and rotation about the axis of each of the support shafts 41 to 43 is thus prevented, and the support shafts 41 to 43 can therefore be fixed in the rocker arms 19 to 21 respectively by a simple arrangement.

When each of the pins 47 to 49 are fixed in the corresponding rocker arms 19 to 21, since both ends of each of the pins 47 to 49 which are inserted into the insertion bores 44 to 46 respectively are crimped, even when each of the pins 47 to 49 has a small diameter, the fixing operation becomes easy in comparison with the case when a press fit type pin is used, and the pins 47 to 49 can be fixed effectively in the rocker arms 19 to 21 with improved operability.

Moreover, each of the pins 47 to 49 are not pressed in but are inserted in the corresponding insertion bores 44 to 46, the internal diameters of each of the insertion bores 44 to 46 may be set so as to have a comparatively large allowance relative to the outer diameters of the corresponding pins 47 to 49, and the widths of the corresponding engage grooves 50 to 52 may also be set so as to have a comparatively large allowance relative to the diameters of the pins 47 to 49. By so doing, each of the pins 47 to 49 can easily be engaged with the corresponding engage grooves 50 to 52 by inserting the pins 47 to 49 into the insertion bores 44 to 46 respectively without strictly setting the positions of support shafts 41 to 43 in the circumferential direction, and the operation of fixing each of the pins 47 to 49 in the rocker arms 19 to 21 respectively becomes easy.

Since both ends of each of the pins 47 to 49 are crimped with flat punches 82, 83, by setting the diameters of the flat punches 82, 83 so as to be larger than the diameters of the pins 47 to 49, even if the position of crimping with the flat punches 82, 83 relative to the pins 47 to 49 is slightly displaced, the pins 47 to 49 can be crimped effectively and degradation of the rigidity of the crimped parts due to displacement of the crimping position can be prevented. Furthermore, since the inner diameters of the recesses 80, 81 . . . are set so as to be larger than the outer diameters of the flat punches 82, 83 so that the flat punches 82, 83 can be housed inside the recesses 80, 81 . . . connected to the opposite ends of the insertion bores 44 to 46, both ends of the pins 47 to 49 are crimped inside the recesses 80, 81 . . . , and the crimped parts thus do not protrude from the outer surfaces of the rocker arms 19 to 21. Moreover the length of the insertion bores 44 to 46, that is to say, the length of the pins 47 to 49 can be reduced by the portions corresponding to the recesses 80, 81 . . . , deformation of the middle parts of the pins 47 to 49 due to the crimping can be prevented as much as possible thus enhancing the precision with which the support shafts 41 to 43 are positioned by the pins 47 to 49, at the same time the inertial mass of the rocker arms 19 to 21 can be reduced by the lightening of the whole of rocker arms 19 to 21 that is achieved, and thus high speed rotation of the internal combustion engine can advantageously be effected.

Furthermore, since the hardness of at least the parts of the pins 47 to 49 which engage with the engage grooves 50 to 52 (areas subjected to high frequency hardening) is comparatively high (for example, $H_v$ 579 to 832), it is possible to position the support shafts 41 to 43 effectively while preventing abrasion and deformation of the pins 47 to 49 as much as possible, and since the hardness of both ends of the pins 47 to 49 (unhardened area) is comparatively low (for example, $H_v$ 180 to 260), the crimping operation becomes easy thus enhancing the precision.

Furthermore, the support shafts 41 to 43 are formed in a cylindrical shape so as to fit the timing piston 63, the regulating member 65 and the switch over piston 64 of the associative operation switching means 23 in a slidable manner, and since the maximum depths of the engage grooves 50 to 52 provided on the corresponding support shafts 41 to 43 are set so as to be less than ½ of the diameters of the pins 47 to 49 respectively, it is possible to prevent degradation of the rigidity of the support shafts 41 to 43 in the area where the engage grooves 50 to 52 are provided, and thus a smooth sliding operation of the timing piston 63, the regulating member 65 and the switch over piston 64, that is to say, a smooth switch over operation of the associative operation switching means 23 can be guaranteed.

In the first driving rocker arm 19, the through passage 70 which connects the oil passage 68 of the rocker shaft 22 to the hydraulic chamber 67 of the associative operation switching means 23 is provided such that it extends in a plane almost perpendicular to the direction in which each of the rocker arms 19 to 21 are arranged, and the through passage 70 has a cross-sectional shape in which the dimension in a direction almost perpendicular to the direction in which each of the rocker arms 19 to 21 is arranged is longer than the dimension in a direction almost parallel to the direction in which each of the rocker arms 19 to 21 is arranged. The space occupied by the through passage 70 in a direction parallel to the direction in which the rocker arms 19 to 21 are arranged can therefore be reduced as much as possible, and the size of the first driving rocker arm 19 can be reduced correspondingly.

In the first driving rocker arm 19, one end of the support shaft 41 is fitted in the first fitting bore $\mathbf{37}_1$ of the first support wall $\mathbf{31}_1$ so as to fix the support shaft 41 in the first driving rocker arm 41; since the aforementioned through passage 70 is provided in the first driving rocker arm 19 in the side of the first support wall $\mathbf{31}_1$, it is possible to provide the through passage 70 in the first driving rocker arm 19 while preventing the thickness of the first support wall $\mathbf{31}_1$ for fixing the support shaft 41 supporting the roller 28 from increasing. In addition, since the notch 72 having a shape corresponding to the through passage 70 is provided in a part of one end of the aforementioned support shaft 41 corresponding to the aforementioned through passage 70, it is possible to place the through passage 70 closer to the side of the roller 28 while maintaining an adequate contact area between the support shaft 41 and the fitting bore $\mathbf{37}_1$ of the first support wall $\mathbf{31}_1$ of the first driving rocker arm 19 so as to ensure the support strength of the support shaft 41 on the first driving rocker arm 19, and thus the size of the first driving rocker arm 19 can be made yet smaller.

Such an ability to reduce the size of the first driving rocker arm 19 can also reduce the size of the cylinder head 11 to a great extent in a multi-cylinder internal combustion engine of the present embodiment.

On the outer surface of one end of the first driving rocker arm 19 in the axial direction of the rocker shaft 22, the expanded part 19*b* which expands outwards so as to form the through passage 70 is provided, at the same time ribs 71, 71 are provided so as to connect the surrounding edge 19*c* of the aforementioned outer surface and the aforementioned expanded part 19*b*, and it is therefore possible to achieve a weight reduction of the first driving rocker arm 19 while ensuring the rigidity of the expanded part 19*b* forming the through passage 70.

Whilst the through passage 70 is provided in the side of the first support wall $\mathbf{31}_1$ of the first driving rocker arm 19, an insertion bore 44 is provided on the second support wall $\mathbf{31}_2$, with the roller 28 interposed between the first and second support walls $\mathbf{31}_1$, $\mathbf{33}_2$ in order to fix the support shaft 41; a space for providing the insertion bore 44 can be secured while preventing the size of the first driving rocker arm 19 from increasing, and since the insertion bore 44 is provided at a position comparatively far from the hollow through passage 70, it is advantageous in terms of the rigidity of the first driving rocker arm 19.

In the free rocker arm 21, the lubricating oil passage 76 which is connected to the oil passage 68 of the rocker shaft 22 is provided so that it opens at one end thereof onto the inner surface of the second fitting bore $\mathbf{39}_2$; the groove 77, one end of which is connected to one end of the aforementioned lubricating oil passage 76 and the other end of which opens onto the side of the needle bearing 55 is provided on the inner surface of the second fitting bore $\mathbf{39}_2$, thus supplying lubricating oil to the needle bearing 55 from the oil passage 68 via the lubricating oil passage 76 and the groove 77, and therefore by the simple arrangement of providing the lubricating oil passage 76 in the free rocker arm 21 and providing the groove 77 on the inner surface of the second fitting bore $\mathbf{39}_2$ it is possible to supply oil to the needle bearing 55. It is therefore unnecessary to subject the support shaft 43 to a boring process in order to provide a guide for lubricating oil, there is no possibility of the rigidity of the support shaft 43 being degraded and the number of processing steps decreases.

Since the free rocker arm 21 follows the high speed valve operating cam 26 which has a cam profile for high speed operation of the engine, its inertial mass is comparatively large, and the load on the needle bearing 55 becomes comparatively large; by the above-mentioned simple arrangement it is possible to supply lubricating oil effectively to the needle bearing 55, and a reduction in the load applied to the needle bearing can be achieved.

Moreover, the aforementioned lubricating oil passage 76 is formed so as to have a cross-sectional shape in which the dimension in a direction almost perpendicular to the direction in which the rocker arms 19 to 21 are arranged is longer than the dimension almost parallel to the direction in which the rocker arms 19 to 21 are arranged, the space occupied by the lubricating oil passage 76 in a direction parallel to the direction in which the rocker arms 19 to 21 are arranged can be reduced as much as possible, the size of the free rocker arm 21 can be reduced, and thus it is possible to achieve a reduction in the size of the cylinder head 11 of the multi-cylinder internal combustion engine.

In the free rocker arm 21, whilst the lubricating oil passage 76 is provided in the side of the second support wall 332, the insertion bore 46 required to fix the support shaft 43 is provided in the side of the first support wall $\mathbf{33}_1$, and it is possible to secure a space for providing the insertion bore 46 while preventing the size of the free rocker arm 21 from increasing; since the insertion bore 46 is provided at a position comparatively far from the hollow lubricating oil passage 76, it is advantageous in terms of the rigidity of the free rocker arm 21.

The free rocker arm 21 comprises a receiver 62 which is in contact with the lifter 60 of the lost motion mechanism 58, and the receiver 62 is integrally provided in the lower part of the second support wall $\mathbf{33}_2$. It is possible to simplify the structure of the free rocker arm 21 by placing the receiver 62 to the side of the roller 30, at the same time it is possible to prevent the size of the free rocker arm 21 from increasing, and the inertial mass of the free rocker arm 21 can be reduced so as to advantageously effect the high speed rotation of an internal combustion engine.

Moreover, while the support shaft 43 is fixed by the pin 49 in the side of the first support wall $\mathbf{33}_1$, since the receiver 62 is provided on the second support wall $\mathbf{33}_2$, the size and positioning of the insertion bore 46 for inserting and fixing the pin 49 are not limited by the receiver 62, and it is possible to make it difficult for the load from the lost motion mechanism 58 to be applied to the pin 49 thus increasing the strength with which the support shaft 43 is fixed. In addition, since the receiver 62 is integrally provided on the second support wall $\mathbf{33}_2$, even though the hollow lubricating oil passage 76 is provided in the second support wall $\mathbf{33}_2$ it is possible to prevent degradation of the rigidity of the second support wall $\mathbf{33}_2$, and the weight decrease of the second support wall $\mathbf{33}_2$ due to the hollow lubricating oil passage 76 is compensated for by the aforementioned receiver 62 thus achieving a good weight balance between the two support walls $\mathbf{33}_1$, $\mathbf{33}_2$.

Furthermore, the free rocker arm 21 is supported on the rocker shaft 22 in such a manner that the first support wall $\mathbf{33}_1$ provided with the insertion bore 46 for fixing the support shaft 43 is provided on the side of the first driving rocker arm 19, the second driving rocker arm 20 is supported on the rocker shaft 22 in such a manner that the first support wall $\mathbf{32}_1$ provided with the insertion bore 45 for fixing the support shaft 42 is provided on the side of the first driving rocker arm 19, the support shafts 43, 42 are fixed in the free rocker arm 21 and the second driving rocker arm 20 on the side where the timing piston 63 and the switch over piston 64 of the associative operation switching means 23 are inserted and, therefore, insertion of each of the pistons 63, 64 into the support shafts 43, 42 can be carried out smoothly, and the associative operation switching motion of the associative operation switching means 23 becomes smooth.

Each of the rocker arms 19 to 21 is formed by metal injection moulding, the non-circular through passage 70, the two fitting bores $\mathbf{37}_1$, $\mathbf{37}_2$ and the insertion bore 44 can be formed at the same time as the first driving rocker arm 19 is formed, the two fitting bores $\mathbf{38}_1$, $\mathbf{38}_2$, the insertion bore 45 and the opening bore 74 can be formed at the same time as the second driving rocker arm 20 is formed, and the non-circular lubricating oil passage 76, the two fitting bores $\mathbf{39}_1$, $\mathbf{39}_2$ and the insertion bore 46 can be formed at the same time as the free rocker arm 21 is formed. The number of subsequent processing steps of each of the rocker arms 19 to 21 can therefore be reduced as much as possible thus achieving enhancement of the productivity.

Figure 12:
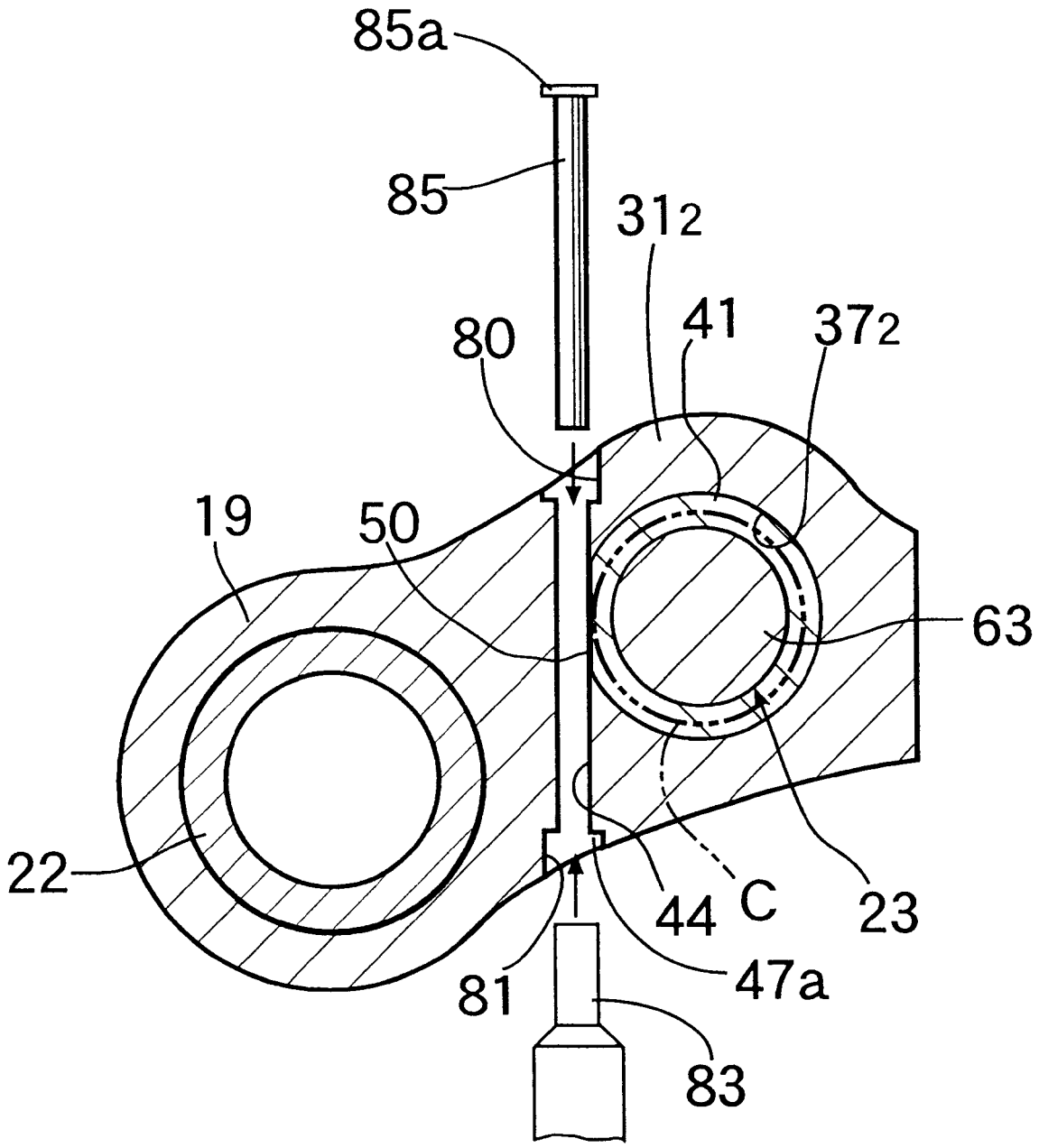
FIG. 12 is a cross-sectional view for explaining the operation of fixing a pin according to a second embodiment of the present invention.

FIG. 12 shows a second embodiment of the present invention and the same reference keys are used for items corresponding to the above-mentioned first embodiment.

A pin 85 engaging with an engage groove 50 of a support shaft 41 is inserted into an insertion bore 44 provided in a second support wall $\mathbf{31}_2$ of a first driving rocker arm 19. One end of the pin 85 is crimped by a flat punch 83 so as to become engaged with a step between one recess 81 and the insertion bore 44, but on the other end of the pin 85 an engage flange 85*a* which engages with a step between the other recess 80 and the insertion bore 44 is integrally formed.

Support shafts 42, 43 are also supported on a second driving rocker arm 20 and a free rocker arm 21 by the same arrangement as that for the fixing structure using the above-mentioned pin 85.

In accordance with the second embodiment, even if the pins 85 . . . have a small diameter, the fixing operation becomes easy in comparison with the case when a press fit type pin is used, the fixing operation is also easy in comparison with the case when both ends of the pins 85 . . . are crimped, and the pins can be fixed effectively in each of the rocker arms 19 to 21 with further improved operability. Furthermore, the crimped part at one end of the pins 85 . . . and the engage flange 85*a* can be housed inside the two recesses 80, 81 and do not protrude from the outer surfaces of the rocker arms 19 to 21, the lengths of the insertion bores 44 to 46, that is to say, the lengths of the pins 85 . . . can be reduced by the portion corresponding to the recesses 80, 81, the precision with which the support shafts 41 to 43 are positioned by the pins 85 . . . can can be improved while preventing deformation of the middle parts of the pins 85 . . . due to the crimping as much as possible, the inertial masses of the above-mentioned rocker arms 19 to 21 can be reduced by the light weight for the whole of rocker arms 19 to 21 that can be achieved, and thus high speed operation of an engine can advantageously be effected.

The above-mentioned embodiment has explained a valve operating system in which connection and connection-release between a plurality of rocker arms 19 to 21 can be switched over by an associative operation switching means 23, but the inventions of claims 1 to 3 can be applied to a valve operating system for an internal combustion engine in which a rocker arm is pressed towards a valve operating cam by a pressing means regardless of the presence or absence of an associative operation switching means.

The embodiments of the present invention have been described in detail above, but the present invention is not limited to the above-mentioned embodiments and can be modified in a variety of ways without departing from the spirit and scope of the invention defined in claims.

What is claimed is:

1. A valve operating system for an internal combustion engine comprising a support shaft for supporting in a rotatable manner a roller which is in rolling contact with a valve operating cam, the support shaft being fitted in a fitting bore provided in a rocker arm, an engage groove which extends in a direction tangential to an imaginary circle about an axis of said support shaft, and which is provided on an outer surface of said support shaft, and a pin engaging with said engage groove and fixed in said rocker arm, wherein an insertion bore extends in a straight line through an inner surface of said fitting bore at a position corresponding to said engage groove of said support shaft and is provided in said rocker arm, and said pin is inserted into said insertion bore and is engaged with said rocker arm by crimping at least one end of said pin with a flat punch so as to be fixed in said rocker arm.

2. A valve operating system for an internal combustion engine according to claim 1, wherein said rocker arm is provided with a pair of recesses which are formed so as to have a diameter larger than an internal diameter of said insertion bore, said recesses are connected to opposite ends of said insertion bore, and open at an outer surface of said rocker arm on opposite sides thereof to each other, one end of said pin is crimped so as to engage with a step between one of said two recesses and said insertion bore, another end of said pin is integrally formed with an engage flange which engages with a step between the other one of said two recesses and said insertion bore, and at least a part of said pin which engages with said engage groove is formed to have a hardness higher than that of said opposite ends of said pin.

3. A valve operating system for an internal combustion engine according to claim 1, wherein said rocker arm is provided with a pair of recesses which are formed so as to have a diameter larger than an internal diameter of said insertion bore, said recesses are connected to the opposite ends of said insertion bore, and open at an outer surface of said rocker arm on opposite sides thereof to each other, opposite ends of said pin which are inserted into said insertion bore so as to engage with said engage groove and are respectively crimped by a flat punch so as to engage with the steps between said two recesses and said insertion bore, and at least a part of said pin which engages with said engage groove is formed to have a hardness higher than that of said opposite ends of said pin.

4. A valve operating system for an internal combustion engine according to claim 1, wherein said fitting bore and said insertion bore are formed in each of a plurality of said rocker arms, a plurality of said support shafts which are each formed in a cylindrical shape having said engage groove are fitted in said fitting bores respectively, a plurality of said pins which are inserted into said insertion bores respectively are engaged with said engage grooves respectively, an associative operation switching means having sliding members which are slidably fitted in said support shafts respectively is provided in said rocker arms so as to switch over between connection and connection-release of said rocker arms, and said engage grooves have maximum depths each set to be less than ½ of the diameter of a corresponding pin engaging with said engage groove.

5. A valve operating system for an internal combustion engine according to claim 4, wherein a pair of recesses are provided on each of a plurality of said rocker arms and are formed so as to have a diameter larger than an internal diameter of said insertion bore respectively, said recesses being connected to opposite ends of said insertion bore respectively, and open at an outer surface of said rocker arm respectively on opposite sides thereof to each other, one end of said pin is crimped so as to engage with a step between one of said two recesses and said insertion bore, and the other end of said pin engages with a step between the other one of said two recesses and said insertion bore.

6. A valve operating system for an internal combustion engine according to claim 5, wherein at least part of each of said pins which engages with each of said engage grooves is formed to have a hardness higher than that of said opposite ends of each of said pins.

* * * * *